US012642400B2

(12) United States Patent
Tyroler

(10) Patent No.: US 12,642,400 B2
(45) Date of Patent: Jun. 2, 2026

(54) WINDOW CLEANING DEVICE

(71) Applicant: TYROLER LTD., Neve Yamin (IL)

(72) Inventor: Dan Tyroler, Yesod HaMa'ala (IL)

(73) Assignee: TYROLER LTD., Neve Yamin (IL)

( * ) Notice: Subject to any disclaimer, the term of this patent is extended or adjusted under 35 U.S.C. 154(b) by 339 days.

(21) Appl. No.: 18/283,432

(22) PCT Filed: Mar. 21, 2022

(86) PCT No.: PCT/IL2022/050313
§ 371 (c)(1),
(2) Date: Sep. 21, 2023

(87) PCT Pub. No.: WO2022/201148
PCT Pub. Date: Sep. 29, 2022

(65) Prior Publication Data

US 2024/0180372 A1 Jun. 6, 2024

(30) Foreign Application Priority Data

Mar. 24, 2021 (IL) ..... 281753

(51) Int. Cl.
*A47L 1/15* (2006.01)
*A47L 13/11* (2006.01)
(Continued)

(52) U.S. Cl.
CPC ..... *A47L 1/15* (2013.01); *A47L 13/11* (2013.01); *A47L 13/12* (2013.01); *A47L 13/258* (2013.01); *A47L 13/42* (2013.01)

(58) Field of Classification Search
CPC ..... A47L 13/11; A47L 13/12; A47L 13/20; A47L 13/254
See application file for complete search history.

(56) References Cited

U.S. PATENT DOCUMENTS 3,721,502 A 3/1973 Ognibene
6,702,497 B1 3/2004 Tien
(Continued)

FOREIGN PATENT DOCUMENTS

CN 204698443 U 10/2015
CN 105595906 A * 5/2016 ..... A47L 1/09
(Continued)

OTHER PUBLICATIONS

Extended European Search Report dated Jan. 29, 2025 as received in Application No. 22774495.0.
(Continued)

*Primary Examiner* — Shay Karls
(74) *Attorney, Agent, or Firm* — Maschoff Brennan

(57) ABSTRACT

The present disclosure provides a cleaning device for cleaning surfaces, typically planar surfaces. The cleaning device includes two functioning elements, a mopping element for allowing mopping the surface with a mop and a wiper element for wiping the surface, typically wiping a portion of the surface that have been mopped by the mop of the mopping element to complete the cleaning process. The cleaning device is designed that one of the elements is further formed with a head unit that is configured to receive an end of a handle, e.g. a rod and the other element is capable of rotating about an axis to allow efficient cleaning process by the device at different portions of the surface in different distances from the subject using the device. Typically, the head unit is formed on the wiper element, the mopping element is capable of rotating about a central axis thereof and the two elements are integrally coupled to one another, e.g. by gluing intended coupling portions of the two elements to one another.

17 Claims, 4 Drawing Sheets

(51) Int. Cl.

| | |
|---|---|
| ***A47L 13/12*** | (2006.01) |
| ***A47L 13/258*** | (2006.01) |
| ***A47L 13/42*** | (2006.01) |

(56) References Cited

U.S. PATENT DOCUMENTS

| | | | | |
|---|---|---|---|---|
| 2011/0107539 | A1* | 5/2011 | Dingert | A47L 13/256 15/231 |
| 2011/0203065 | A1 | 8/2011 | Cassar | |
| 2017/0100012 | A1* | 4/2017 | Tyroler | A47L 13/11 |
| 2017/0215686 | A1 | 8/2017 | Smith et al. | |

FOREIGN PATENT DOCUMENTS

| | | | | | |
|---|---|---|---|---|---|
| CN | 108464764 | A | | 8/2018 | |
| EP | 1 191 873 | B1 | | 9/2003 | |
| EP | 1 677 657 | A1 | | 7/2006 | |
| KR | 20-0261228 | Y1 | | 1/2002 | |
| KR | 20-0282275 | Y1 | | 7/2002 | |
| KR | 2003-0031738 | A | | 4/2003 | |
| KR | 10-0775597 | B1 | | 11/2007 | |
| KR | 10-1036841 | B1 | | 5/2011 | |
| KR | 20-2016-0003991 | U | | 11/2016 | |
| KR | 20170076530 | A | * | 7/2017 | F16B 2/20 |
| WO | 2005/039374 | A1 | | 5/2005 | |
| WO | 2015/198324 | A1 | | 12/2015 | |

OTHER PUBLICATIONS

CN Office Action dated Jun. 13, 2025 as received in Application No. 202210293179.9.

IL Patent Examination Report dated Aug. 24, 2021 as received in Application No. 28175321.

* cited by examiner

WINDOW CLEANING DEVICE

TECHNOLOGICAL FIELD

This invention is in the field of household tools for cleaning purposes, in particular for cleaning windows.

BACKGROUND ART

References considered to be relevant as background to the presently disclosed subject matter are listed below:

WO 2015/198324;

https://www.youtube.com/watch?v=qllBI-ngPM0&feature=emb_logo&ab_channel=TyrolerBrightTools Acknowledgement of the above references herein is not to be inferred as meaning that these are in any way relevant to the patentability of the presently disclosed subject matter.

GENERAL DESCRIPTION

The present disclosure provides a cleaning device for cleaning surfaces, typically planar surfaces. The cleaning device includes two functioning elements, a mopping element for allowing mopping the surface with a mop and a wiper element for wiping the surface, typically wiping a portion of the surface that have been mopped by the mop of the mopping element to complete the cleaning process. The cleaning device is designed that one of the elements is further formed with a head unit that is configured to receive an end of a handle, e.g. a rod and the other element is capable of rotating about an axis to allow efficient cleaning process by the device at different portions of the surface in different distances from the subject using the device. Typically, the head unit is formed on the wiper element, the mopping element is capable of rotating about a central axis thereof and the two elements are integrally coupled to one another, e.g. by gluing intended coupling portions of the two elements to one another.

Thus, an aspect of the present disclosure provides two aspects of the cleaning device.

The first aspect of the cleaning device includes a wiper element, a mopping element, a head unit and a coupling element.

The wiper element comprises a wiper base elongated along a first axis and extending between first and second ends. The wiper element further includes a wiping portion extending from the wiper base to a first direction, the wiping portion is having a wiping edge for engaging a surface, typically a planar surface and in particular a window surface.

The head unit is integral with the wiper base and includes a receptacle with a bore defining a receptacle axis orthogonal to the first axis for receiving an end of a rod. The head unit extends from said wiper base from a different portion of the base than the wiping portion.

The mopping element comprises a mop base having a bottom face and a top face, the bottom face is configured for attaching a mopping substrate thereto.

The coupling element is fixed to the head unit and is coupled to the mopping element in a manner such as to permit the mopping element to rotate about a second axis parallel to the first axis.

The second aspect of the cleaning device includes a wiper element that comprises an elongated wiper base extending along a first axis, and a wiping portion extending from said wiper base. The wiping portion has a wiping edge for engaging a surface, typically a planar surface and in particular a window surface. The wiper element further comprises a wiper attachment portion.

The cleaning device further includes a mopping element that comprises a mop base extending along a second axis, parallel to the first axis, and having a bottom face and a top face. The mop base is configured for attaching a mopping substrate on the bottom face. The mopping element further comprises a mop attachment portion.

The cleaning device further includes a head unit that is integral with the wiper base or the mop base and comprising a receptacle for receiving an end of a handle or a rod.

The wiper attachment portion and the mop attachment portion are attached one to another, e.g. by gluing or by welding, such that either (i) said mop base is rotatable about said second axis, or (ii) said wiper base and therefore the wiping edge is rotatable about said first axis.

The following embodiments are described with respect to any one of the above aspects of the cleaning device.

In some embodiments of the cleaning device, the head unit extends from the wiper base to second direction, generally opposite the first direction. It is to be understood that the head unit does not necessarily extend at an exact opposite direction to the wiping portion but can be in a range of ±90° to the opposite direction of the extension of the wiping portion.

In some embodiments of the device, the coupling element comprises a head unit portion extending from the head unit and a mopping element portion extending from the mopping element. The head unit portion and the mopping element portion are integrated with one another.

In some embodiments of the cleaning device, the head unit portion and the mopping element portion are glued or welded one to another.

In some embodiments of the cleaning device, the head unit, the wiper element and the head unit portion are a single-piece molded article. Namely, the head unit, the wiper element and the head unit portion are made of a single mold.

In some embodiments of the cleaning device, the mopping element and the mopping element portion is a single-piece molded article. Namely, the mopping element and the mopping element portion are made of a single mold.

In some embodiments of the cleaning device, the wiper element, the head unit and the mopping element are made of an elastomeric material, such as silicone rubber or rubber.

In some embodiments of the cleaning device, the coupling element and the mopping element are pivoted to one another by a rigid pivot element. In some embodiments, rotation of the rigid pivot element results in rotation of the mop base and the mopping element portion rotates about the rigid pivot element. The head unit and the wiper element rotate with mopping element portion due to the integration between them.

In some embodiments of the cleaning device, peripheral end segments of the pivot element are received in two elongated bores that are formed in elongated abutments on the top face of the mopping element and a central segment of said pivot element is pivotally coupled to said coupling element or specifically to the mopping element portion.

In some embodiments of the cleaning device, the central segment of the rigid pivot element defines the second axis.

In some embodiments of the cleaning device, each of the two elongated bores has an open end, the two open ends face one another on opposite sides of a central gap, spanned by the central segment.

In some embodiments of the cleaning device, the mop base comprises one or more integral ribs on the top face, extending from said abutments in a direction normal to the second axis.

In some embodiments of the cleaning device, the ribs extend symmetrically from the two sides of said abutments.

In some embodiments of the cleaning device, the bottom face has fastening elements for said mopping substrate.

In some embodiments of the cleaning device, the fastening elements are one of a hook-and-pile couple, e.g., Velcro.

In some embodiments of the cleaning device, the fastening elements are seamed or glued to said bottom face of the mop base.

In some embodiments of the cleaning device, a peripheral portion of the mop base is flexible for allowing it to bend around corners.

In some embodiments of the cleaning device, the mop base is generally planar.

In some embodiments of the cleaning device, the wiper base comprises a reinforcing element spanning at least a portion between said first and second ends. The reinforcing element is enveloped by the thermoset material, e.g. rubber or silicon rubber. The enveloping is performed during the molding process such that the reinforcing element is part of the single-piece molded article. In some embodiments, the reinforcing element spans the majority of the length between the first and second ends.

In some embodiments of the cleaning device, the wiping edge is flexible and adapted to be bent upon application of force thereon while engaging said surface.

In some embodiments of the cleaning device, the receptacle axis forms an angle with respect to a plane defined by the wiper element. More specifically, the plane is defined by the wiper base and the wiping portion. The head unit and so as the receptacle defining the receptacle axis extend from a generally opposite side of the extension of the wiping portion.

In some embodiments of the cleaning device, the coupling element extends in a direction generally normal to a plane defined by the wiper element and also orthogonal to the first axis.

In some embodiments of the cleaning device, wherein the head unit is integrated to the wiper base via a neck portion. The neck portion is narrower than the wiper base and the head unit, thus allowing the wiper element, and in particular the wiping portion, to bend about the first axis, namely a limited rotation about the first axis. It is to be noted that the neck portion is also a part of the one-piece molded article of the wiper element and the head unit.

In some embodiments of the cleaning device, the head unit comprises a head unit base. The neck portion and the head unit base forms a T shape. The leg of the T shape is integral with the wiper base.

In some embodiments of the cleaning device, the head unit base comprises a rigid reinforcing element extending along at least the majority of its length along the first axis. The rigid reinforcing element grants a structural strength to the head unit base such that it remains relatively rigid while allowing the neck portion to be bent. The rigid reinforcing element is embedded within the molded article, namely it is surrounded by the molded material.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 1A-1B are perspective views; FIG. 1C is a side view; FIG. 1D is a top view; and FIG. 1E is a bottom view.

DETAILED DESCRIPTION

Figure 1A:
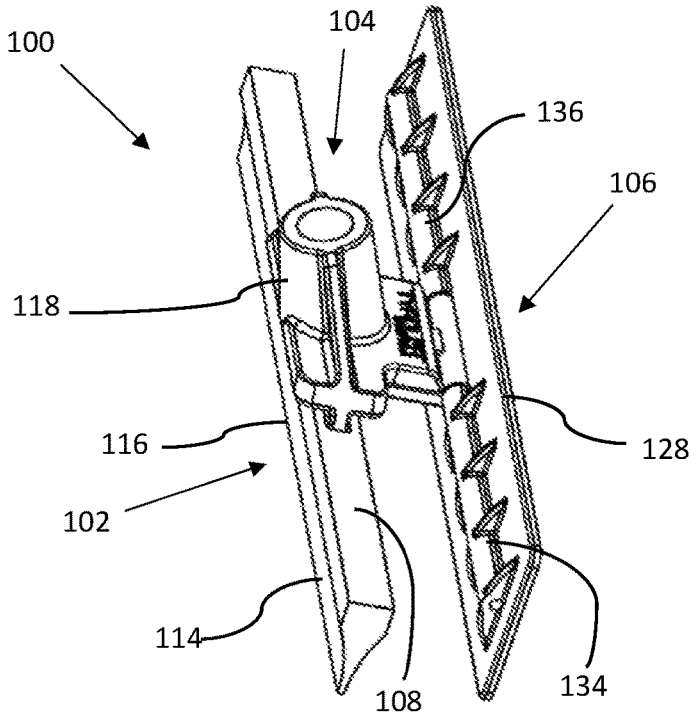
FIGS. 1A-1E are schematic illustrations of different views of a non-limiting example of the cleaning device of the present disclosure.
Figure 1B:
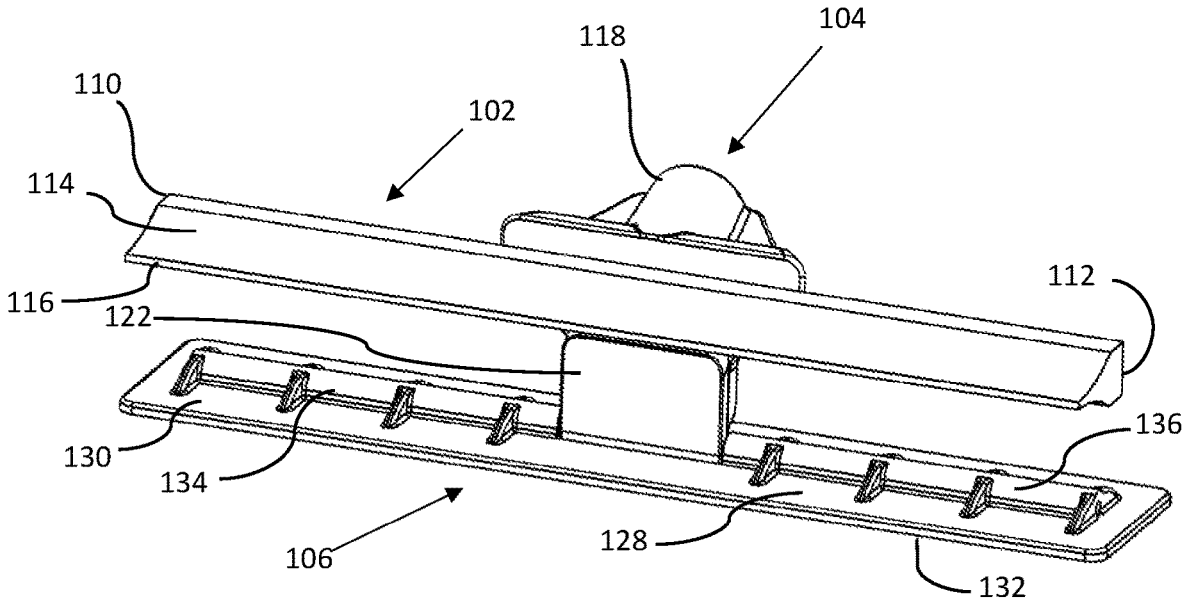
Figure 1C:
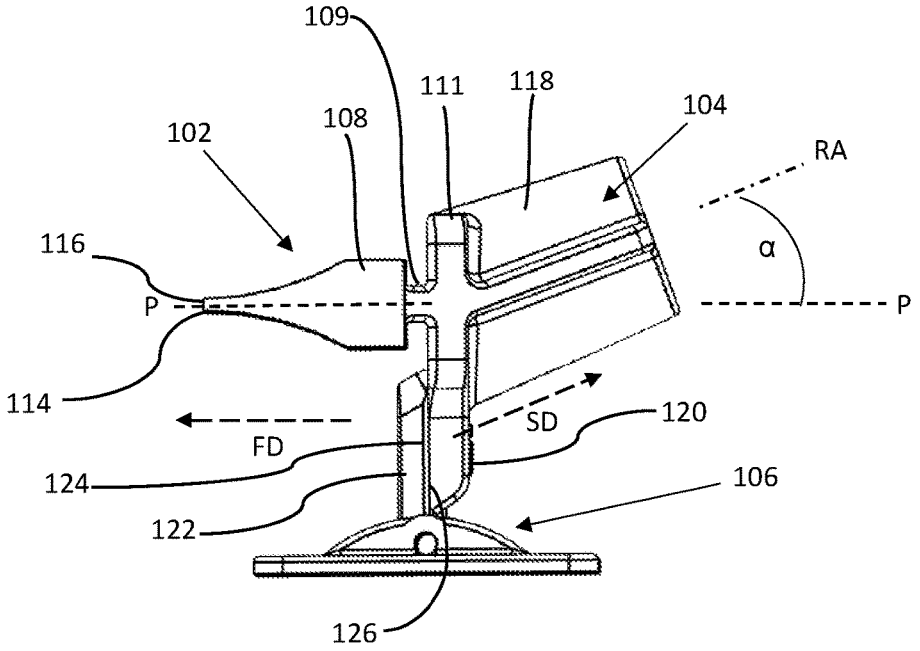
Figure 1D:
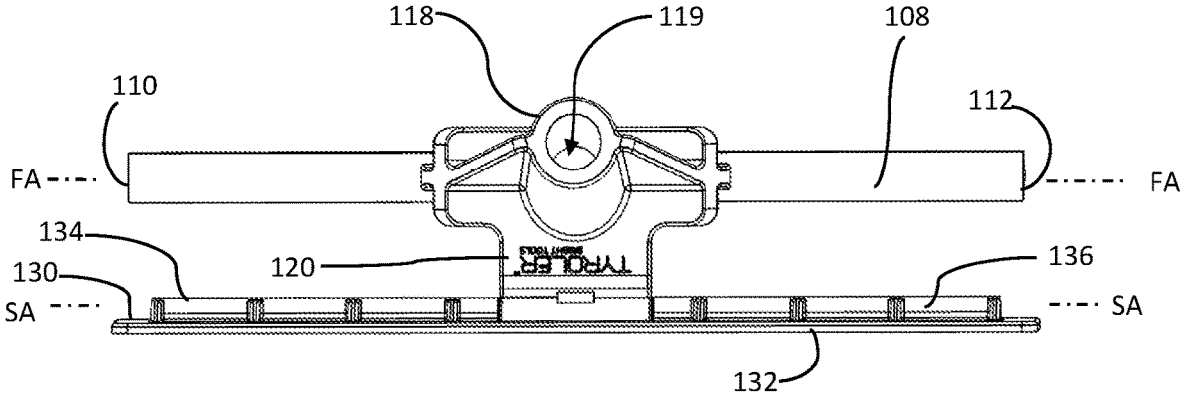
Figure 1E:
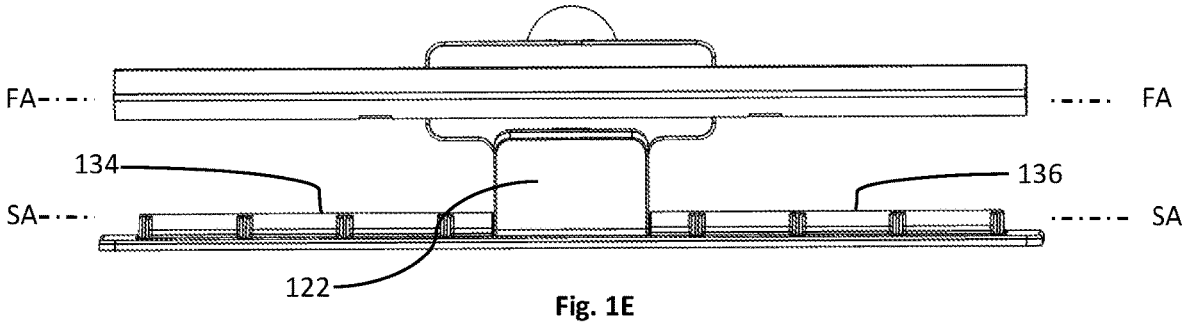

Reference is first being made to FIGS. 1A-1E, which are schematic illustrations of different views of a non-limiting example of an embodiment of the cleaning device of the present disclosure. The cleaning device 100 includes a wiper element 102, a head unit 104 and a mopping element 106, all being integrated to form the cleaning device 100. The wiper element 102 has a wiper base 108, elongated along a first axis FA and extending between first and second wiper base ends 110 and 112, as can be best seen in FIGS. 1D-1E. A wiping portion 114 extends from the wiper base 108 towards a first direction FD, orthogonal to the first axis FA. The wiping portion 114 is tapered and has a wiping edge 116 that is configured to engage the surface to be cleaned, the wiping portion 114 and the wiping edge 116 are flexible, thus upon application of force on the wiping portion 114, it bends to allow efficient wiping of the surface. The head unit 104 is integral with the wiper base 108 and extends therefrom towards a second direction SD, different than the first direction FD. The head unit 104 and the wiper base 108 are integrated via a neck portion 109 that its flexibility allows the wiper element to bend about the first axis FA with respect to the head unit 104. In other words, the neck portion 109 allows the wiper element 102 a limited rotation about the first axis FA. The neck portion 109 and a head unit base 111, which forms the bottom portion of the head unit 104, forms a T shape, and the leg of this T shape structure is linked to the wiper base 108. The head unit base 111 includes a rigid reinforcing material (not shown) embedded within to increase the rigidity of the head unit base 111. The head unit includes a rod receptacle 118 defining a receptacle axis RA orthogonal to the first axis FA for receiving an end of a rod. The end of the rod is received in a bore 119 formed in the rod receptacle 118. The wiper element 102 defines a plane P and the receptacle axis RA forms an angle $\alpha$, with said plane as can be best seen in FIG. 1C. The head unit 104 includes a head unit coupling portion 120 configured for coupling with a mopping element coupling portion 122 of the mopping element 106. Each of the head unit coupling portion 120 and the mopping element coupling portion 122 has respective faces 124 and 126 intended for their coupling to one another by gluing or welding the faces one another. The mopping element 106 includes an elongated mop base 128 having top and bottom faces 130 and 132. The bottom face 132 is configured for attachment with a mopping cloth. Two elongated and co-axial bores are formed in two abutments 134 and 136 on the top face 130 with a gap between their openings. The mopping element further includes a rigid element (not shown) that has two peripheral segments that are accommodated in the two bores 134 and 136 and a central segment spanning said gap between their openings.

The mopping element coupling portion 122 is pivotally coupled to the central segment, thus allowing the mopping element 106 to pivot/rotate about a second axis SA, defined by the central segment and parallel to the first axis FA.

The wiper element 102, the head unit 104 and the head unit coupling portion 120 are a first single-piece molded article; and the mopping element 106 and the mopping element coupling portion 122 are a second single-piece molded article. The first and the second single-piece molded articles are coupled to one another via the coupling portions 120 and 122 to form the cleaning device 100.

In the figures throughout the application, like elements of different figures were given similar reference numerals shifted by the number of hundreds corresponding to the number of the respective figure. For example, element 228 in FIG. 2 serves the same function as element 128 in FIGS. 1A-1E.

Figure 2:
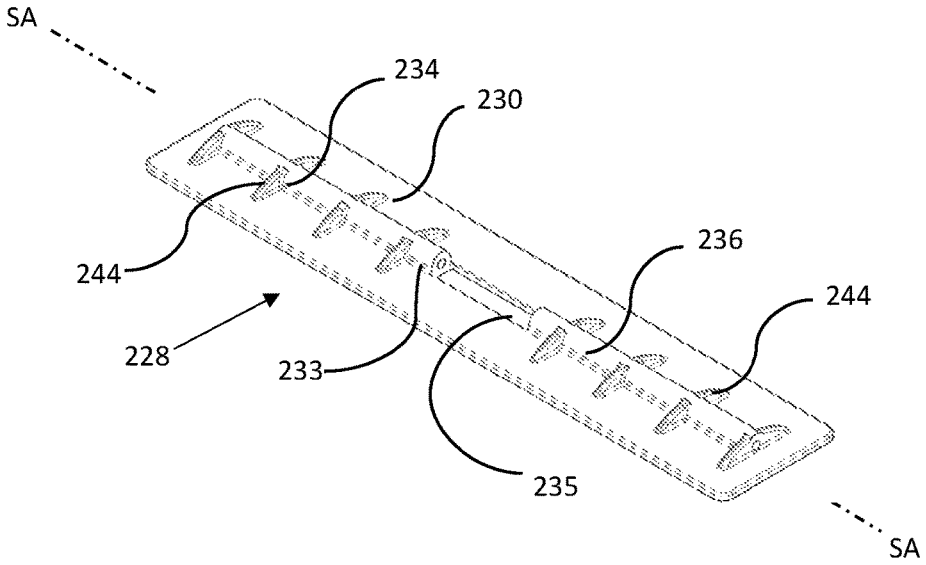
FIG. 2 is a schematic illustration of a non-limiting examples of the mop base of the cleaning device of the present disclosure.

Reference is now being made to FIG. 2, which is a schematic illustration showing a non-limiting embodiment of the mop base of the mopping unit. The mop base 228 has a top face 230, two elongated bores 233 and 235 are formed on the top face 230 by respective two elongated abutments 234/236 protruding from the top face 230. An elongated rigid (not shown) element is intended to be received in the two bores and spanning the gap between them. The segment of the rigid element that spans the gap between the bores is exposed and the mopping element coupling portion (not shown) is pivotally coupled thereto to allow its rotation about a second axis SA defined by the bores. Reinforcing ribs 244 extends from the abutments perpendicularly to the second axis SA to provide rigidity to the central portion of the mop base, while the peripheral portion of the mop base remains flexible due to the flexible materials it is made of. The mop base is a single-piece molded article, namely it is a result of a single mold and a single molding process.

Figure 3:
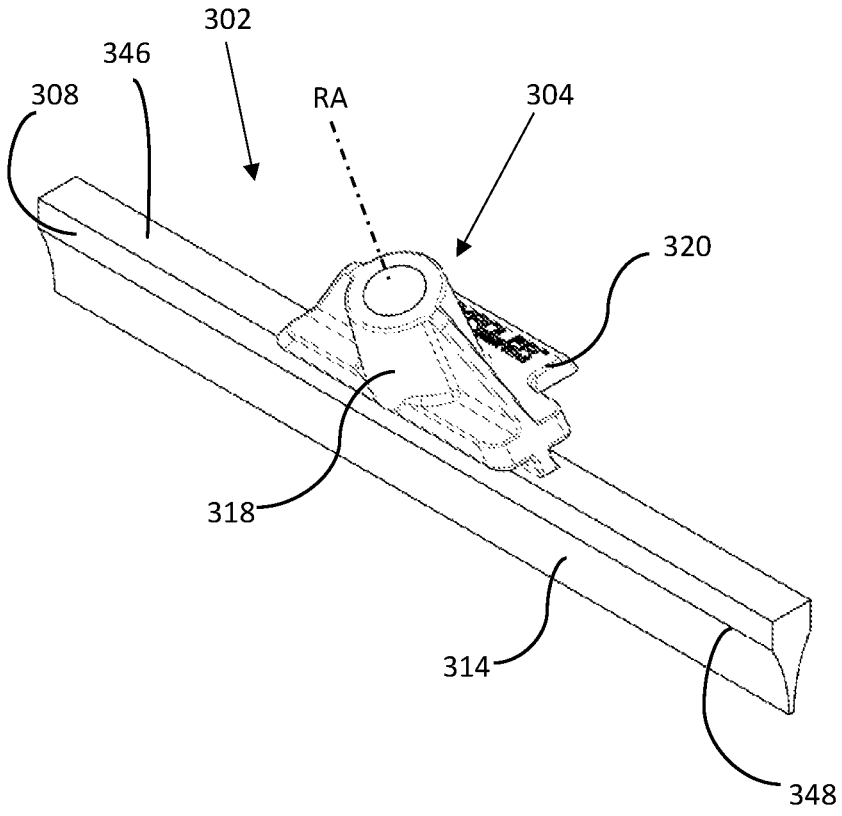
FIG. 3 is a schematic illustration of a non-limiting examples of the wiper element and the head unit of the cleaning device of the present disclosure.

FIG. 3 is a schematic illustration showing a non-limiting embodiment of the wiper element, the head unit and the head unit coupling portion. The wiper element 302, the head unit 304 and the head unit coupling portion 320 are a single-piece molded article, namely it is a result of a single mold and a single molding process. Thus, the wiper element 302, the head unit 304 and the head unit coupling portion 320 are integral to one another in the structural level. The wiper element 302 includes a wiper base 308 having an upper side 346 and a bottom side 348. A tapered wiping portion 314 with a wiping edge 316 extending from the bottom side 348 and the head unit 304 is formed on the upper side 346. The head unit 304 comprises a rod receptacle 318 that extends along a receptacle axis RA. The receptacle axis RA forms an angle $\alpha$ with a plane P defined by the wiper element 302, namely by the plane defined by the wiper base 308 and the wiping portion 314. The head unit coupling portion 320 laterally extends from the head unit 304, generally normal to the plane P defined by the wiper element 302. The head unit coupling portion 320 has a face 324, which in this embodiment is being the bottom face that has a matching surface to that of the respective mopping element coupling portion face so as to be coupled to one another by gluing, welding or other coupling means.

The invention claimed is:

1. A cleaning device, comprising:

a wiper element, a mopping element, a head unit and a coupling element;

the wiper element including:

a wiper base elongated along a first axis and extending between first and second ends, and a wiping portion extending from said wiper base to a first direction, said wiping portion is having a wiping edge for engaging a surface;

the head unit integral with the wiper base and comprising a receptacle with a bore defining a receptacle axis orthogonal to the first axis for receiving an end of a rod; and the mopping element including:

a mop base having a bottom face and a top face, wherein the bottom face is configured for attaching a mopping substrate thereto; and the coupling element being fixed to the head unit and being coupled to the mopping element in a manner such as to permit the mopping element to rotate about a second axis parallel said first axis;

wherein said coupling element comprises a head unit portion extending from the head unit and a mopping element portion extending from the mopping element, the portions being coupled with one another; and wherein the head unit, the wiper element and said head unit portion are a single-piece molded article.

2. The cleaning device of claim 1, wherein the head unit portion and the mopping element portion are coupled by gluing or welding.

3. The cleaning device of claim 1, wherein the mopping element and said mopping element portion is a single-piece molded article.

4. The cleaning device of claim 1, wherein the wiper element, the head unit and the mopping element are made of an elastomeric material.

5. The cleaning device of claim 1, wherein the coupling element and the mopping element are pivoted to one another by a rigid pivot element.

6. The cleaning device of claim 5, wherein peripheral end segments of the pivot element are received in two elongated bores that are formed in elongated abutments on the top face of the mopping element and a central segment of said pivot element being pivotally coupled to said coupling element.

7. The cleaning device of claim 6, wherein:

the central segment defines said second axis; and each of the two elongated bores has an open end, the two open ends face one another on opposite sides of a central gap, spanned by said central segment.

8. The cleaning device of claim 6, wherein the mop base comprises one or more integral ribs on the top face, extending from said abutments in a direction normal to the second axis.

9. The cleaning device of claim 8, wherein the ribs extend symmetrically from the two sides of said abutments.

10. The cleaning device of claim 1, wherein:

said bottom face has fastening elements for said mopping substrate;

the fastening elements are one of a hook-and-pile couple; and the fastening elements are seamed or glued to said bottom face.

11. The cleaning device of claim 1, wherein a peripheral portion of the mop base is flexible.

12. The cleaning device of claim 1, wherein the mop base is generally planar.

13. The cleaning device of claim 1, wherein the wiper base comprises a reinforcing element spanning at least a portion between said first and second ends.

14. The cleaning device of claim 1, wherein the wiping edge is flexible.

15. The cleaning device of claim 1, wherein said receptacle axis forms an angle with respect to a plane defined by the wiper element.

16. The cleaning device of claim 1, wherein said coupling element extends in a direction generally normal to a plane defined by the wiper.

17. The cleaning device of claim 1, wherein:

the head unit comprises a neck portion coupling it to the wiper base;

the head unit comprises a head unit base, the neck portion and the head unit base forms together a T shape; and the head unit comprises a rigid reinforcing element extending along at least a portion between two ends of the head unit.

* * * * *